US008596185B1

(12) United States Patent
Soong et al.

(10) Patent No.: US 8,596,185 B1
(45) Date of Patent: Dec. 3, 2013

(54) ADJUSTABLE GAS BLOCK METHOD, SYSTEM AND DEVICE FOR A GAS OPERATION FIREARM

(75) Inventors: Robert Soong, Longwood, FL (US); Phil Picardat, Apopka, FL (US); Gary Coffman, Mascotte, FL (US)

(73) Assignee: MicroMOA, LLC, Longwood, FL (US)

( * ) Notice: Subject to any disclaimer, the term of this patent is extended or adjusted under 35 U.S.C. 154(b) by 0 days.

(21) Appl. No.: 13/451,832

(22) Filed: Apr. 20, 2012

Related U.S. Application Data

(60) Provisional application No. 61/569,929, filed on Dec. 13, 2011.

(51) Int. Cl.
*F41A 5/28* (2006.01)

(52) U.S. Cl.
USPC ..... 89/193

(58) Field of Classification Search
USPC ..... 89/193, 129.01, 191.01, 191.02, 192; 42/49.01, 71.01, 148, 111, 108, 90; 29/426.1, 525.11; 137/505; 251/304
See application file for complete search history.

(56) References Cited

U.S. PATENT DOCUMENTS

| | | | | |
|---|---|---|---|---|
| 7,610,844 | B2 * | 11/2009 | Kuczynko et al. | 89/193 |
| 7,856,917 | B2 | 12/2010 | Noveske | |
| 7,921,760 | B2 | 4/2011 | Tankersley | |
| 2010/0282066 | A1 * | 11/2010 | Tankersley | 89/193 |
| 2011/0179945 | A1 * | 7/2011 | Clark et al. | 89/193 |

OTHER PUBLICATIONS

Noveske, 5.6mm Switchblock, Clamp-On, online, 1 page, retrieved on Apr. 13, 2012, retrieved from http://noveskerifleworks.com/cgi-bin/imcart/display.cgi?cat=155.

Larue, PST—Port Selectro Technology, online, 6 pages, retrieved on Apr. 13, 2012, retrieved from http://www.ar15.com/forums/t_2_210/181922_Pg_1_UPDATE_The_LaRue_OBR_Port_Selector_Technology_tm_REVEALED_.html.

Gun Digest Magazine, AR-15, AR-10 Adjustable Gas Blocks, online, 2 pages, retrieved on Apr. 13, 2012, retrieved from http://secure.adpay.com/Gun%20Digest%20Magazine%20%20Blade%20Magazine/2541516/clicknbuy.aspx?networkview=False&catid=5500&pcatid=500MS&procid=78c11c36-f675-4b1b-81e9-e234fd952818.

Syrac Ordnance, Adjustable Low Pro Gas Block, online, 2 pages, retrieved on Apr. 13, 2012, retrieved from http://www.syracordnance.com/.

JP Enterprises, Inc., JP Adjustable Gas Systems, online, 3 pages, retrieved on Apr. 13, 2012, retrieved from http://www.jprifles.com/1.4.6_gs.php.

(Continued)

*Primary Examiner* — Michelle Clement
*Assistant Examiner* — John D Cooper
(74) *Attorney, Agent, or Firm* — Brian S. Steinberger; Phyllis K. Wood; Law Offices of Brian S. Steinberger, P.A.

(57) ABSTRACT

Methods, systems and devices for an adjustable gas block with variable gas port dimensions to control the amount of gas in the gas block before the gas enters into the gas tube. The adjustable gas block includes a gas block barrel bore to slide the block over a barrel and a gas tube bore to mate with the firearm gas tube, a gas port between the barrel bore and the gas tube bore, a sliding adjustment plate with different adjustment gas ports to slide one of the gas ports into alignment with the block gas port and the barrel gas port, and a spring to hold the sliding gas port in alignment with the barrel gas port. An alignment hole in the gas tube bore can align the block gas port with the barrel gas port.

15 Claims, 15 Drawing Sheets

(56) References Cited

OTHER PUBLICATIONS

Kies Firearms, MKI Triggers, online, 5 pages, retrieved on Apr. 13, 2012, retrieved from http://www.kiesfirearms.com/Parts_and_Accessories.html.

Precision Reflex, Inc. Low Profile Adj Stl Gas Block 750 Diameter, online, 1 page, retrieved on Apr. 13, 2012, retrieved from http://www.precisionreflex.com/Detail.aspx?PROD=186780&CAT=4274.

MGI Military, MGI Regulated M16 Rifle Gas Tube, online, 2 pages, retrieved on Apr. 13, 2012, retrieved from https://www.mgi-military.com/store/index.php?product_id=10&type=&category=.

* cited by examiner 120
150
220

120
150
210
220

120

120
210

120
210
150
220

120
220
210

ADJUSTABLE GAS BLOCK METHOD, SYSTEM AND DEVICE FOR A GAS OPERATION FIREARM

This application claims the benefit of priority to U.S. Provisional Application No. 61/569,929 filed on Dec. 13, 2011.

FIELD OF THE INVENTION

The present invention related generally to firearms and, more particularly, to a device, system, and method for an adjustable gas block with variable gas port dimensions that replaces the conventional gas block to control the amount of gas in the gas block before the gas enters into the gas system of a gas operated firearm.

BACKGROUND AND PRIOR ART

AR-15 rifles and similarly styled firearms have become a best-selling category of sporting firearms. The main mechanism of operation for the rifle utilizes a gas tube which can be seen by prior art patent by Eugene Stoner U.S. Pat. No. 2,951,424. Which is referred to as the Stoner gas system hereinafter. The Stoner gas system routes gas from a port in the barrel directly to a chamber formed in the bolt carrier. The bolt acts as the piston and is sealed with gas rings.

As the bullet is accelerating rapidly down the bore, it passes the gas port and gas begins to flow into the gas block where it is directed toward the bolt carrier via the gas tube. The pressure is high in the barrel, usually 15,000 psi depending on barrel length until the bullet leaves the muzzle. Typically a firearm gas block is a solid piece of metal that goes over the gas port of a barrel to capture the propellant gas to direct that gas to a gas tube or piston. A problem can occur when the gas pressure is too high or too low.

The AR15/M16/AR10 is a gas operated firearm which uses some of the propellant gases in its normal operation and that gas is expelled through a gas port in the barrel and either goes through a gas tube which ultimately dumps the gas in a chamber known as the bolt carrier which is the Stoner gas system; or is used to propel a piston which pushes an op-rod that impacts the bolt carrier known as 'piston' operated firearm.

In either case, when a sound suppressor is used, it creates a great amount of backpressure which has the following adverse affects.

1. Increased fouling which in turn decreases the reliability
2. Increased cyclic rate of fire
3. With the increased rate of fire, it makes it difficult for operators to control the firearm since it is different from what they are used to.
4. Increased cyclic rate also increases parts wear
5. The backpressure leaks gas through the back of the receiver which ends up in the operator's eyes making it more difficult to focus on the target To solve the problems with the prior art, the Govnah gas regulation system addresses the adverse effects. The Govnah regulated gas block is initially comprised of three different variants. The first variant (v1) uses a sliding block that is configurable to allow the operator to choose from two different positions. One position for a suppressor attached to the barrel and the other position when a suppressor is not used. The second variant (v2) also uses a sliding block but has a third, middle position to completely disable the gas system which then requires the user to manually cycle the action. The 'no gas port' position can be used to eliminate any fouling from entering the firearm via the gas tube when a 22LR conversion kit is used. The third position can also have a larger than normal port size to allow more gas into the system for adverse conditions. The third variant (v3) uses a circular block for multiple positions of varying port dimensions, including no port, to allow the user to regulate the amount of gas entering the system to compensate for any changing variables that affect the cycling of the gas operated host firearm.

Known prior art patents include U.S. Pat. No. 7,856,917 issued to Noveske and U.S. Pat. No. 7,921,760 issued to Tankersley. Noveske discloses an adjustable gas block designed to interface with an autoloading firearms gas system and has three positions of adjustment that are selected if a silencer is in use, not in use, or if the user desires to stop the autoloading function of the firearm entirely. This design works by restricting the flow of gas from the gas port in the barrel and does not vent excess gas into the atmosphere around the gas block.

The above device uses a rotating drum with two openings in the drum and a gas port to control the amount of gas that enters into the gas tube which are all pre-determined by the factory. The Govnah uses a sliding or rotating block which can be swapped out by the end user to meet the user's requirements. While the Govnah uses standard military specification gas tubes, the Noveske device uses a proprietary straight gas tube and as a result is elevated higher. In result, the Noveske device will not fit under a rail system. While the Noveske device can by adjusted by hand, this is not ideal when it is hot. It requires a special tool or gloves to adjust safely when hot. The Govnah can be adjusted by any device that can push the adjustment plate, ideally a bullet.

There are applications and benefits for each of the two devices which include providing users with two (v1), three (v2) or multiple (v3) positions for gas regulation on the AR15/M16/AR10 platform using unmodified standard gas tubes; they do not require special tools to adjust the position; they reduce logistic issues in regards to parts availability since they work with standard gas tubes; and they work with drop in 'piston' operated conversion kits that are on the market such as the Ares Defense GXR-35 and Osprey Defense OPS-416. Neither of which have a built in mechanisms to manually select the gas intake of the respective systems.

The Govnah regulated gas block (v1 and v2) is low profile which allows it to fit under a rail system and still be accessible for adjustment using the tip of a bullet or other small diameter object to select the gas setting. Since the Govnah regulated gas block fits under a rail system, the design itself is protected by the rail system to prevent any damage or inadvertent changing of the gas setting. The Govnah also uses a symmetrical moving block which controls the gas. Since it is symmetrical, it can be installed two different ways. This allows the user to decide which direction they prefer to have the adjustment plate set.

The Govnah (v3) provides users with a regulated gas block that can quickly adjust to multiple known port diameters to change the amount of gas that is entering the host firearm's gas system without disassembly or special tools. This feature is useful when the user changes any variable that affects the functioning of the gas operated host firearm such as different buffers, sound suppressors, ammunition or springs.

The Govnah also incorporates an alignment hole for installation into the gas block body itself while prior art U.S. Pat. No. 7,921,760 accomplishes this with a separate installation device which requires dimpling the barrel to maintain alignment once the actual gas block is installed. The Govnah doesn't require dimpling since alignment is performed with the actual gas block body not a separate installation device.

What is needed to solve the problem with the prior art gas block is an adjustable gas port assembly that functions as a gas regulator for AR-15 rifles and similarly styled firearms. The present invention uses an adjustable gas block with variable gas port dimensions to control the amount of gas in the gas block before the gas enters into the gas tube or piston.

SUMMARY OF THE INVENTION

A primary objective of the present invention is to provide methods, systems and devices for an adjustable gas block with variable gas port dimensions that replaces the conventional gas block to control the amount of gas in the gas block before the gas enters into the gas tube of a gas operated firearm.

A secondary objective of the present invention is to provide methods, systems and devices for an adjustable gas block for the AR15/M16/AR10 family of firearms, but is not limited to only that family and can be used for virtually any firearm that is gas operated.

A third objective of the present invention is to provide methods, systems and devices for an adjustable gas block with a sliding adjustment plate with different adjustment plate gas ports to slide one of the different gas ports into alignment with the adjustable gas block gas port and the barrel gas port.

A fourth objective of the present invention is to provide methods, systems and devices for an adjustable gas block with an alignment hole in the gas tube bore can be used to align the adjustable gas block gas port with the barrel gas port.

A fifth objective of the present invention is to provide methods, systems and devices for an adjustable gas block which utilizes a standard un modified gas tube and barrel.

A sixth objective of the present invention is to provide methods, systems and devices for an adjustable gas block which requires no special tools to change the adjustment. Use the tip of a bullet or other small diameter object.

A seventh objective of the present invention is to provide methods, systems and devices for an adjustable gas block which can fit under a rail system and can still be adjusted with no special tools An eighth objective of the present invention is to provide methods, systems and devices to extend the service life of a barrel when the gas port has been eroded.

A ninth objective of the present invention is to provide methods, systems and devices that gives the operator the option to allow excess gas into the firearm for adverse conditions.

A tenth objective of the present invention is to provide methods, systems and devices that have a modular regulation mechanism in this case the regulator plate. The regulator plate can be swapped out by the end user for varying conditions or for replacement due to wear.

A first preferred embodiment provides adjustable gas block assembly that includes an adjustable gas block having a gas block barrel bore to slide the adjustable gas block over a barrel of a firearm and a gas tube bore to mate with the gas tube of the firearm. The adjustable gas block includes a gas port in the adjustable gas block between the barrel bore and the gas tube bore, a sliding adjustment plate having two or more different adjustment plate gas ports movably positioned between the adjustable gas block barrel bore and the gas tube bore in the gas block to slide one of the two or more different adjustment plate gas ports into alignment with a gas port between the barrel bore and the gas tube bore and the barrel gas port, a spring assembly to hold a selected one of the two or more different adjustment plate gas ports in the sliding adjustment plate in alignment with a barrel gas port, and set screws for attaching the adjustable gas block to the barrel of the firearm.

The adjustable gas block can include an alignment hole in the top of the gas tube bore in alignment with the gas port in the adjustable gas block and the barrel gas port.

The sliding adjustment plate includes a first adjustment plate gas port and a second adjustment plate gas port that is larger in diameter than the first adjustment plate gas port and can alternatively include a third adjustment plate gas port that is larger in diameter (or no port) than the second adjustment plate gas port. The sliding adjustment plate can include one or more adjustment plate baffles in a top side of the sliding adjustment plate to capture a gas escaping from the space between the adjustment gas plate and the gas tube bore. The adjustable gas block can include adjustable gas block baffles parallel to the one or more adjustment plate baffles in the adjustable gas block below the sliding adjustment plate. The spring assembly includes detent dimples in one side of the sliding adjustment plate each aligned with one of the two or more adjustment plate gas ports, a detent pin to mate with the adjustment plate detent dimples and a detent pin spring to releasably secure the detent pin in the adjustment plate detent dimple until a force is applied to move the sliding adjustment plate between two or more positions.

A second preferred embodiment provides a method to control the amount of gas in the gas block before the gas enters into a gas tube or piston that includes removing a prior art gas block from a firearm that uses gas operation, sliding an adjustable gas block with a barrel bore and a gas tube bore onto a barrel of the firearm, securing the adjustable gas block with two or more set screws in the base of the adjustable gas block, and sliding an adjustment plate to align one of two or more different diameter gas ports with a gas tube port.

A third embodiment provides an adjustable gas block that includes a body with a gas block barrel bore to slide the adjustable gas block over a barrel of a firearm and a gas tube bore to mate with the gas tube of the firearm, a gas port in the adjustable gas block between the barrel bore and the gas tube bore, a sliding adjustment plate with two or more different diameter gas ports movably positioned to slide one of the two or more different adjustment plate gas ports into alignment with the adjustable gas block gas port and the barrel gas port, and a spring assembly to hold a selected one of the different adjustment plate gas ports in alignment with a barrel gas port, threaded holes in a bottom of the adjustable gas block to accept set screws to attach the adjustable gas block to the barrel of the firearm.

Further objects and advantages of this invention will be apparent from the following detailed description of preferred embodiments which are illustrated schematically in the accompanying drawings.

DESCRIPTION OF THE PREFERRED EMBODIMENTS

Figure 2:
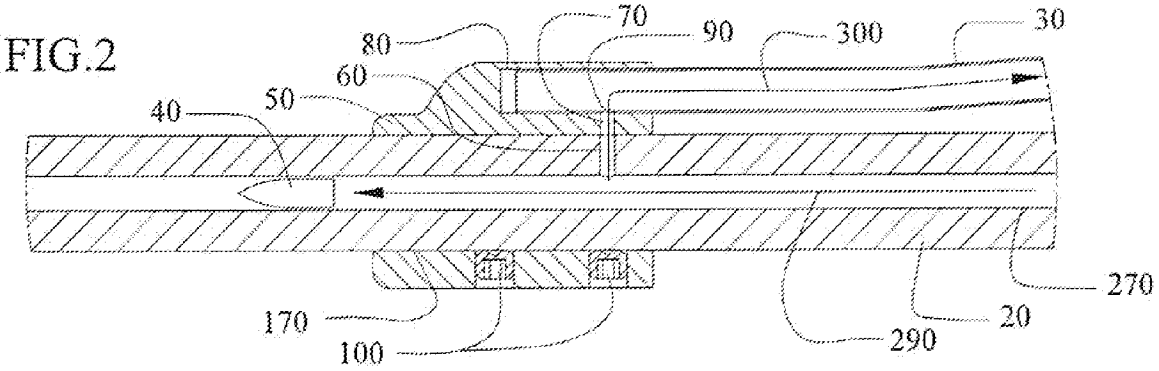
FIG. 2 shows a section detail of prior art gas block installation of FIG. 1.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

The following is a list of reference numerals used in the description and the drawings to identify components:

10 Rifle (Prior Art)
20 Rifle barrel (Prior Art)
30 Gas tube (Prior Art)
40 Bullet (Prior Art)
50 Gas Block (Prior Art)
60 Gas port in barrel (Prior Art)
70 Gas port in block (Prior Art)
80 Gas tube bore in block (Prior Art)
90 Gas port in gas tube (Prior Art)
100 Set screws secure block to barrel
110 New adjustable gas port assembly
120 Sliding adjustment plate (2 position)
130 Detent pin
140 Detent pin spring
150 Adjustment plate gas port
160 Adjustable gas block
170 Gas block barrel bore (Prior Art)
180 Adjustable gas block barrel bore
190 Sliding adjustment plate (3 position)
200 Adjustment block alignment hole
210 Gas trap baffles on adjustment plate
220 Detent dimples
230 Gas trap baffles on gas block
240 Gas port in adjustment gas block
250 New adjustable gas port assembly (3 positions)
270 Rifle bore
280 Alignment pin
290 Bullet fired from rifle pressurizes bore
300 Pressure travels through gas port and gas tube to operate gas actuated rifle mechanisms.

Figure 1:
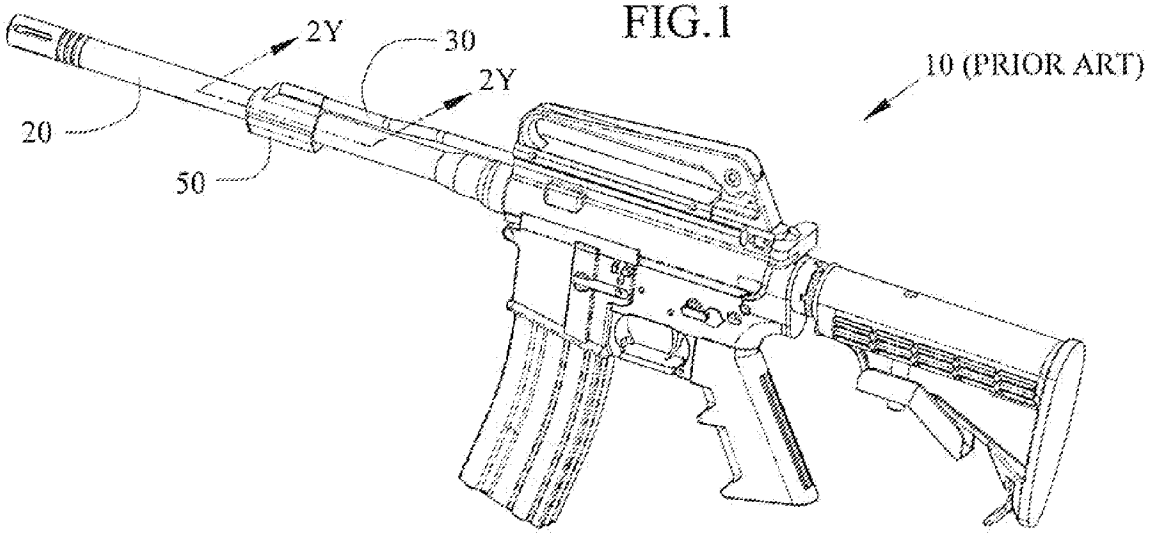
FIG. 1 is a top perspective view of rifle with prior art gas block installation.

FIG. 1 is a top perspective view of rifle 10 with prior art gas block installation showing the rifle barrel 20, the gas tube 30 and gas block 50. FIG. 2 shows a section detail of prior art gas block installation showing the barrel 20, the rifle bore and a bullet 40 fired from the rifle pressurized bore 290. Also shown is the prior art gas block 50 and the gas block barrel bore 170 that is secured to the barrel with set screws 100.

The main mechanism of operation for the rifle is the Stoner gas system. Gas in the barrel 20 is trapped as the bullet 40 moves past a gas port 70 located above the rifle's front sight base. As shown, the gas port includes the gas port in the barrel 60, the gas port in the block 70 and the gas port in the gas tube. The gas rushes into the gas ports in the barrel and the block 60 and 70, through the gas port 90 and down the gas tube 30. Here, the gas tube 30 protrudes into a "gas key" (not shown) which accepts the gas and funnels it into the bolt carrier. The bolt unlocks when enough gas pressure is generated.

Figure 4:
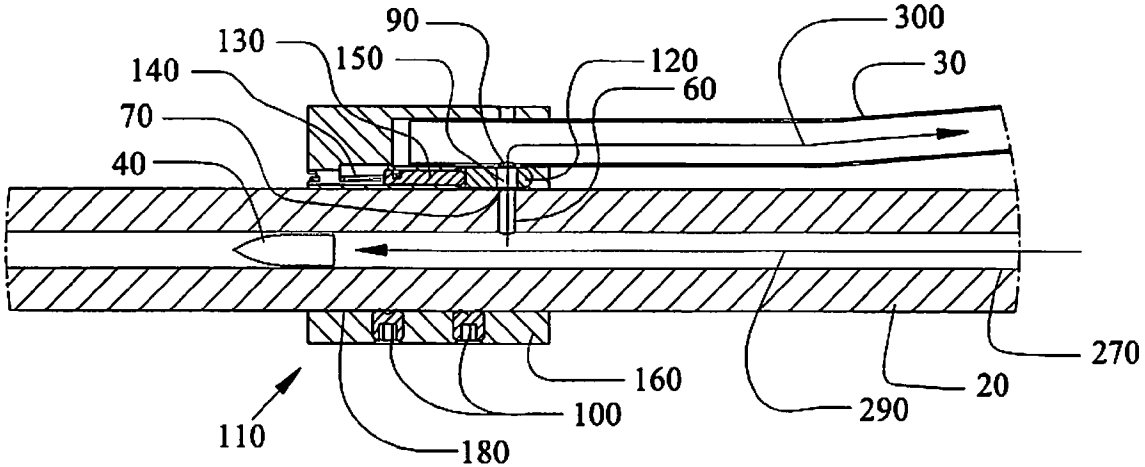
FIG. 4 is a section detail of new adjustable gas block installation of FIG. 3.
Figure 3:
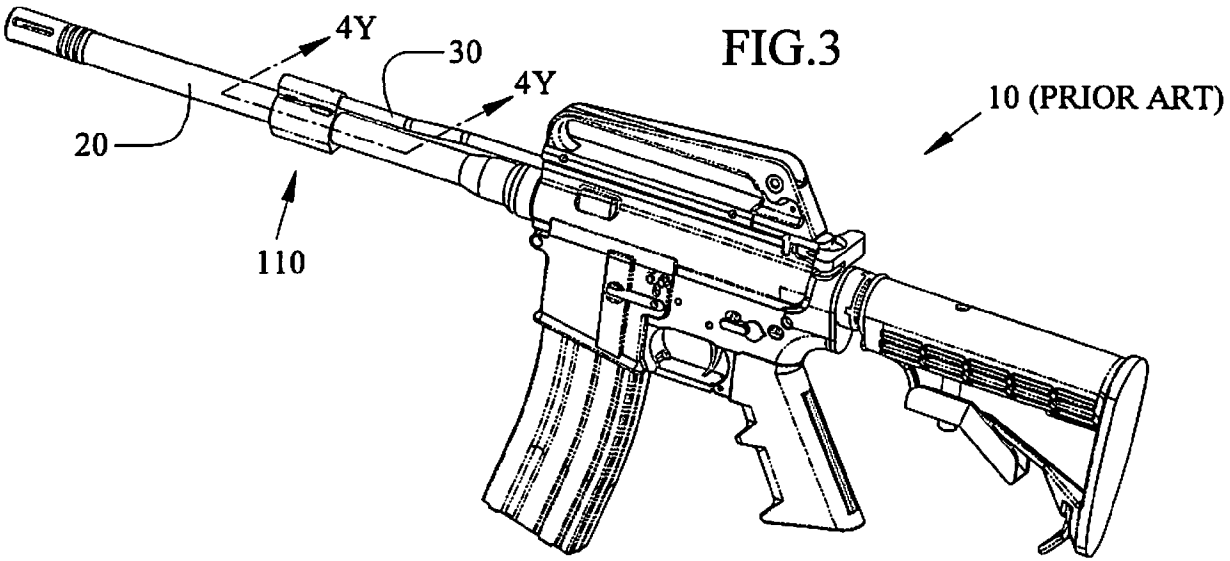
FIG. 3 is a top perspective view of a rifle with new adjustable gas block installation according to the present invention.

FIG. 3 is a top perspective view of a rifle 10 with an adjustable gas block 110 installation according to the present invention. FIG. 4 is a section detail of new adjustable gas block assembly 110 installed on a rifle. The adjustable gas block 160 is installed by sliding the adjustable gas block onto the barrel and attaching the adjustable gas block to the rifle barrel 20 with set screws 100. As shown, the assembly includes a gas block barrel bore 180, a gas tube bore 80 in the gas block 160 and a sliding adjustment plate 150 between the barrel bore and gas tube bore. The gas port 70 in the adjustable gas block 160 is aligned with the barrel gas port 60, both of which are aligned to feed into the gas tube gas port 90.

Figure 8:
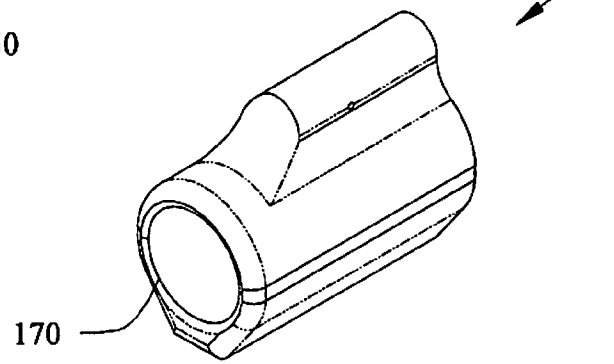
FIG.8 (PRIOR ART)
FIG. 8 is a right perspective view of the prior art gas block of FIG. 1.
Figure 5:
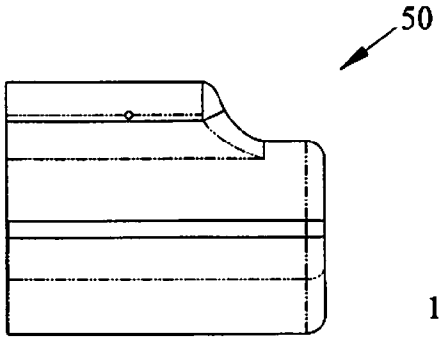
FIG.5 (PRIOR ART)
FIG. 5 is a side view of a prior art gas block of FIG. 1.
Figure 6:
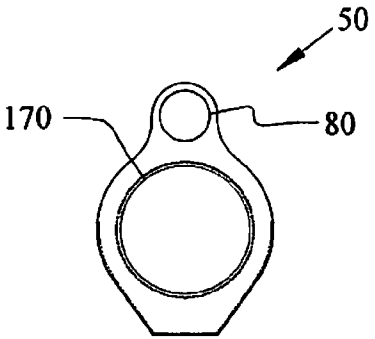
FIG.6 (PRIOR ART)
FIG. 6 is a rear view of the prior art gas block of FIG. 1.
Figure 9:
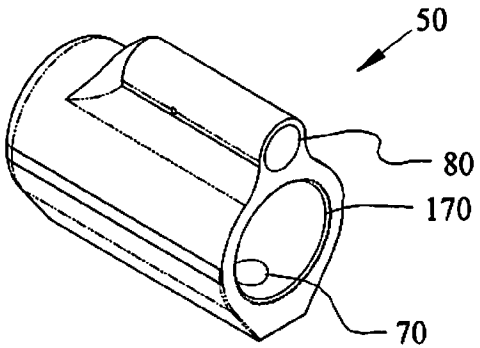
FIG.9 (PRIOR ART)
FIG. 9 is a left perspective view of the prior art gas block of FIG. 1.
Figure 7:
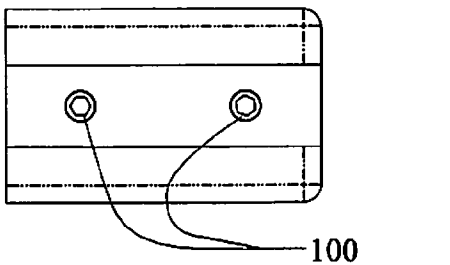
FIG.7 (PRIOR ART)
FIG. 7 is a bottom view of the prior art gas block of FIG. 1.

Referring back to the prior art gas block installation shown in FIG. 1, details of the gas block are show in FIG. 5-9 which show a side view, rear view, bottom view, right perspective view and left perspective view, respectively, of the prior art gas block. The right view in FIG. 8 shows gas block barrel bore 170. Rear view shown in FIG. 6 shows both the gas block barrel bore and the gas tube bore 80. The bottom view of FIG. 7 shows the set screws 100 that secure the gas block 50 to the rifle barrel 20. Looking into the gas block barrel bore 170 in FIG. 9 shows the gas tube bore 70 in the gas block.

Figure 13:
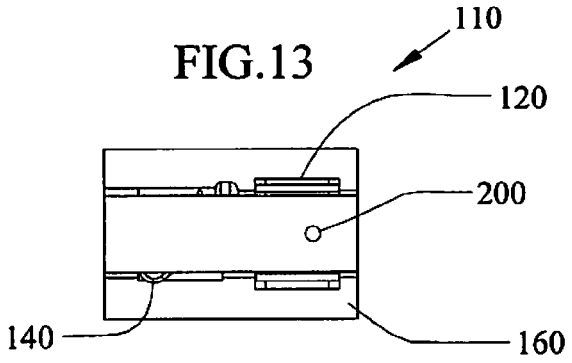
FIG. 13 is a top view of the adjustable gas block shown in FIG. 3.
Figure 11:
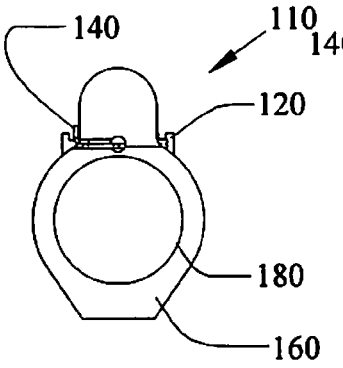
FIG. 11 is a front view of the adjustable gas block shown in FIG. 3.
Figure 10:
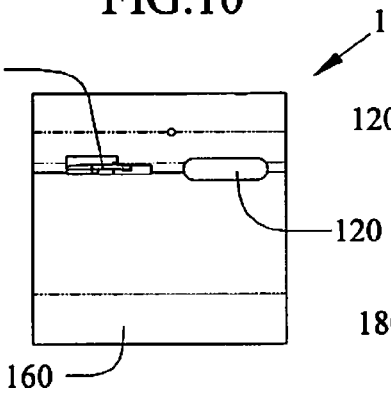
FIG. 10 is a side view of an adjustable gas block shown in FIG. 3.
Figure 12:
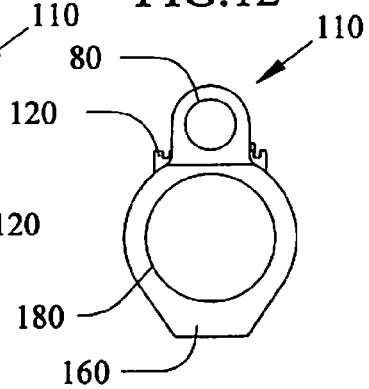
FIG. 12 is a rear view of the adjustable gas block shown in FIG. 3.
Figure 14:
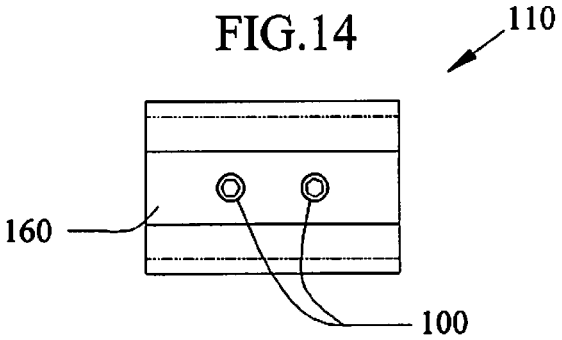
FIG. 14 is a bottom view of the adjustable gas block shown in FIG. 3.

In contrast, FIGS. 10-14 show details of the adjustable gas block according to the present invention. FIGS. 10 and 13 show adjustable gas block assembly 110 showing the sliding adjustment plate 120 and detent pin spring 140 in the adjustable gas block 160. The front view of the adjustable gas block shown in FIG. 11 shows the positional sliding adjustment plate 120 and the detent spring in relation to the barrel bore 180 while the back view shown in FIG. 12 shows the relational position with the gas tube bore 80 in the adjustable gas block 160. Similar to the prior art, the adjustable gas block is attached to the barrel with set screws 100 as shown in FIG. 14.

Figure 15:
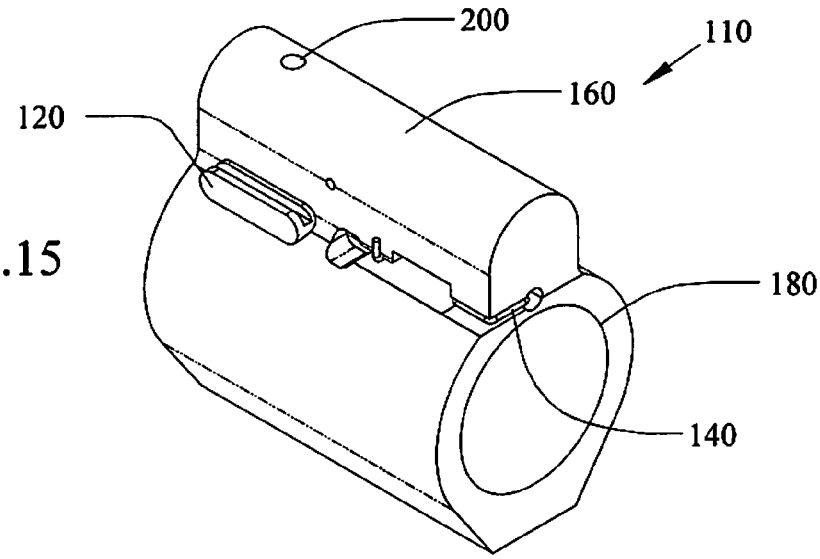
FIG. 15 is a left perspective view of the adjustable gas block shown in FIG. 3.
Figure 16:
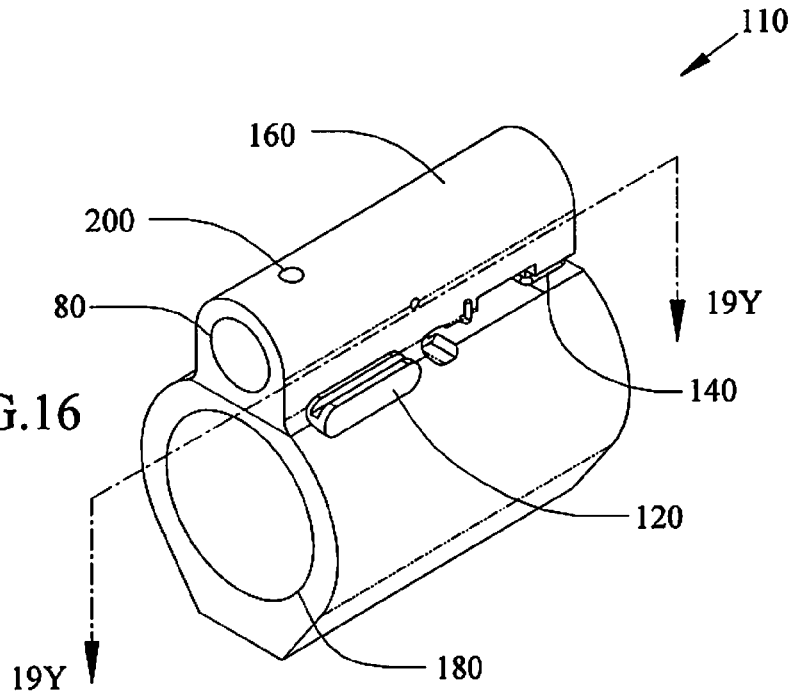
FIG. 16 is a right perspective view with section lines (also see FIGS. 19-22 & 31-35).

FIGS. 15 and 16 are left and right perspective views, respectively, of the adjustable gas port assembly 110 showing the adjustable gas block 160, the sliding adjustment plate 120, the adjustment block alignment hole 200, and the adjustment gas block barrel bore 180. Unlike the prior art gas blocks, in a preferred embodiment of the present invention the adjustable gas block 160 includes adjustment block alignment hole 200 in the gas tube. With the prior art gas blocks, it is common for the gas block to be mis-aligned with the barrel's gas port. Some users don't realize that you can install a gas tube after installing the gas block.

After the adjustable gas block 160 is mounted on the barrel 20 without the gas tube 30 installed, prior to tightening the set screws 100, the user inserts a drill rod or gauge pin into the alignment hole 200 to make sure the drill rod or gauge pin goes all the way into the barrel's gas port 60 to ensure that there is no alignment issue. After confirming alignment, the set screws are tightened and the gas tube 30 is installed by inserting the gas tube into the upper receiver upside down, rotating the gas tube 180 degrees then inserting the gas tube into the adjustable gas block 160 and inserting the gas tube roll pin. FIG. 16 also includes section lines relating to FIGS. 19-22 and 31-35.

Another novel feature is the location of the mounting set screws 100 that secure the adjustable gas block 160 to the rifle barrel 20. The mounting set screws 100 are shifted approximately one-half inch forward toward the muzzle to avoid misalignment of the gas port 60 in the barrel. The placement of the set screw addresses a common problem associated with the prior art replacement gas ports that have the same set screw locations. For example, alignment of the Govnah regulator is critical to proper operation. To prevent mis-alignment, the mounting location of the set screws in the present invention have been moved so the set screws are not inserted into any pre-existing grooves on a barrel, if any are present.

Figure 17:
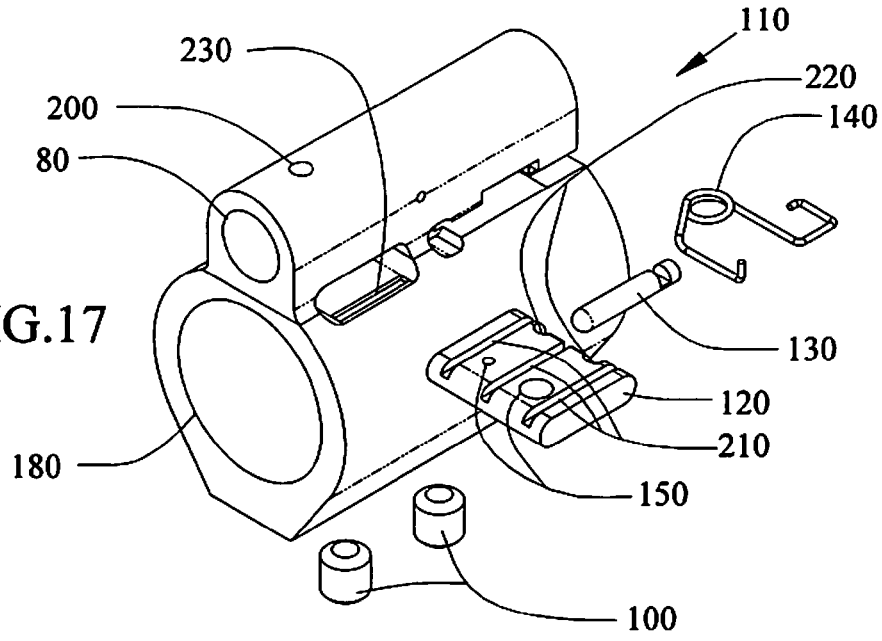
FIG. 17 is a top exploded perspective view of a 2 position embodiment.
Figure 18:
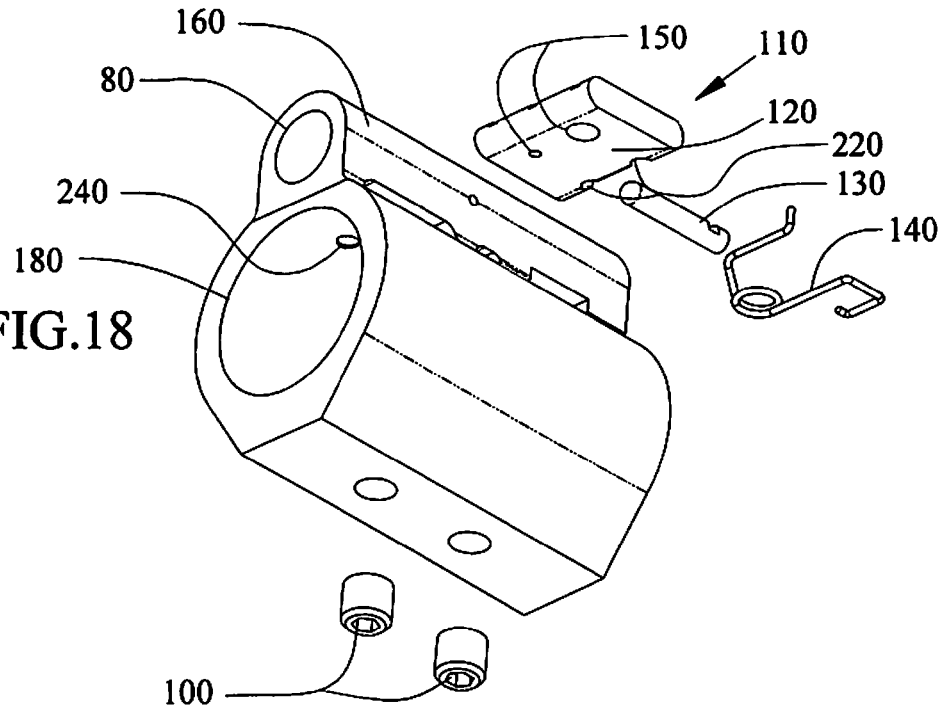
FIG. 18 is a bottom exploded perspective view of the 2 position embodiment.

FIGS. 17 and 18 are top and bottom, respectively, exploded perspective views of a 2 position embodiment of the present invention showing the sliding adjustment plate 120 with two different size adjustment plate gas ports 150 and the adjustable gas block alignment hole 200. The sliding adjustment plate 120 is firmly held in place by the detent pin 130 and detent pin spring 140. The sliding adjustment plate 120 has two detent dimples configured to mate with the rounded end of the detent pin. The detent spring 140 applies sufficient force to hold the sliding adjustment plate 120 in place when the pin 130 is in the sliding adjustment plate dimple 220. Since the sliding plate dimples 220 are rounded, when the user applies a force to change the position of the sliding adjustment plate 150, the detent pin 130 is dislodged to allow the sliding adjustment plate 120 to move. The sliding adjustment plate 120 moves until the detent pin 130 is seated in the other sliding adjustment plate dimple 220 aligning the other adjustment plate gas port 150 with the gas port 240 in the gas block and the barrel gas port.

Figure 20:
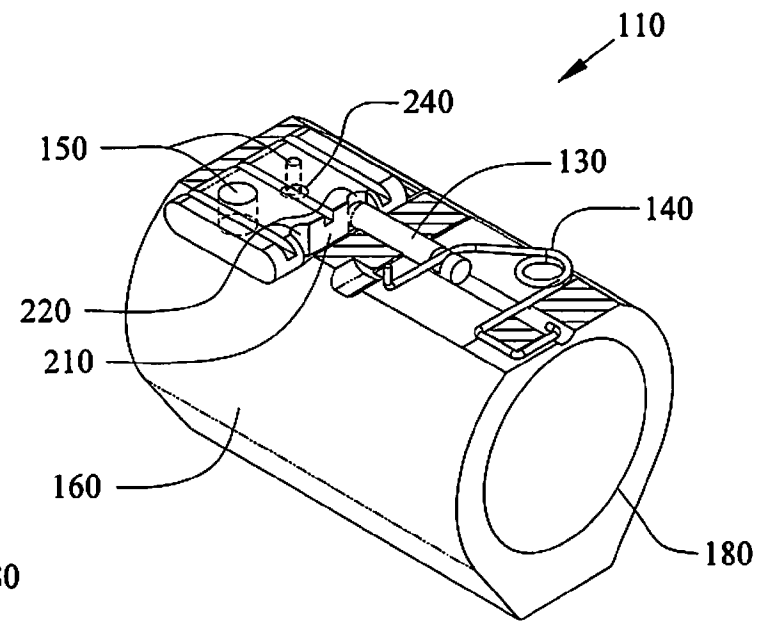
FIG. 20 is a sectioned perspective showing small hole in adjustment plate aligning with gas block gas port. Detent pin is shown seated into an adjacent detent dimple.
Figure 19:
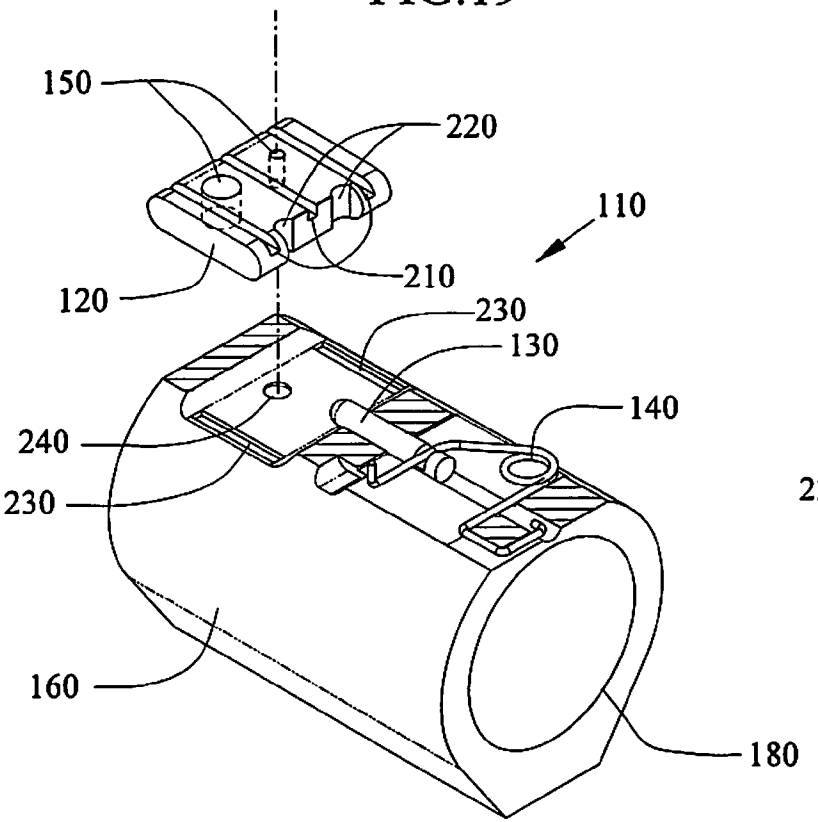
FIG. 19 is a top sectioned perspective showing 2 position adjustment plate lifted to expose the gas port.

Details of the sliding adjustment plate 120 are shown in FIGS. 19 and 20 which show a top sectioned perspective showing the 2 position adjustment plate 120 lifted to expose gas port 240 in the gas block 160 and a sectioned perspective showing the small gas port in adjustment plate aligned (dashed line) with the gas block gas port 240. The detent pin 130 is shown seated in an adjacent detent dimple 220. The detent pin 130 is located in a trough in the adjustable gas block 160 parallel with the barrel of the firearm and the detent pin is configured to hold the detent pin 130 securely in the trough to prevent the detent pin 130 from moving sideways when the sliding adjustment plate 120 slides between the two different gas port 150 positions. The detent pin 130 has a notch cut into it so that the detent spring 140 can pull the detent pin back so the regulator can be removed without tools. The detent spring 140 can also be used to aid in removing the detent pin 130 from the gas block body.

Figure 22:
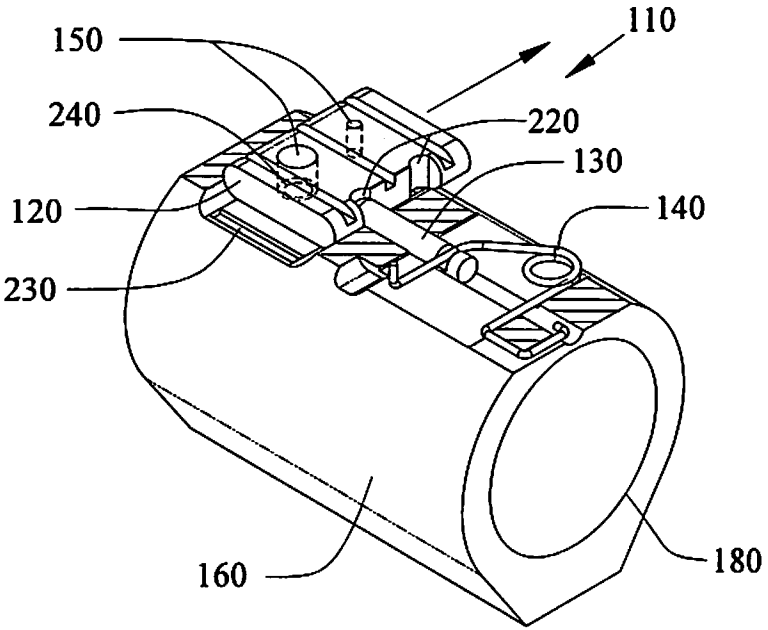
FIG. 22 is a left sectioned perspective showing large hole in adjustment plate aligning with gas block gas port. Detent pin is shown seated into adjacent detent dimple.
Figure 21:
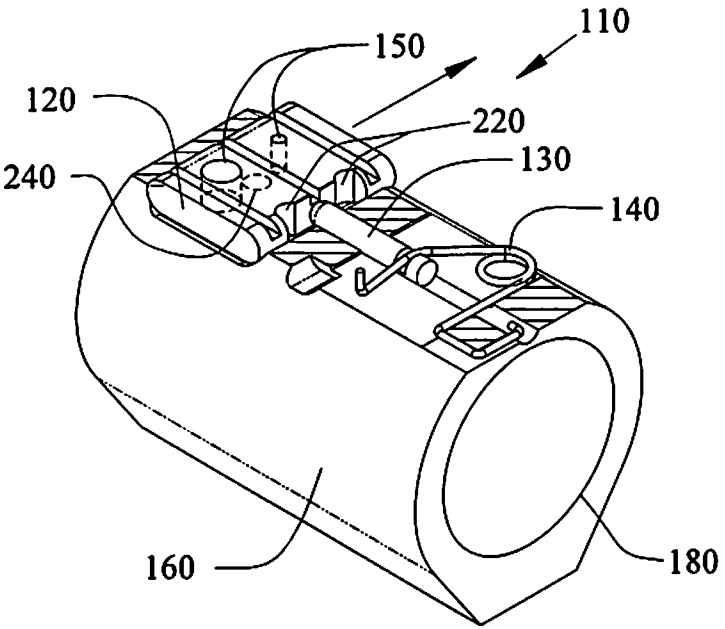
FIG. 21 is a sectioned perspective showing adjustment plate in transition between its two positions. Detent pin showing sliding on surface between the detent dimples.

FIG. 20 shows the sliding adjustment plate 120 in a first position and extending outwardly from the left side of the gas block 160, FIG. 21 shows the sliding adjustment plate 120 between the two different adjustment plate gas ports 150, and FIG. 22 shows the sliding adjustment plate 120 in the second position and extending outwardly from the right side of the gas block 160. As shown, the sliding adjustment plate 120 has right and left sides that extend rearwardly as stops to prevent the sliding adjustment plate 120 from being unintentionally removed from the adjustable gas block 160.

Another feature of the adjustable gas block of the present invention are the gas trap baffles 230 on the adjustable gas block 160 shown in FIG. 19 and the gas trap baffles 210 shown in FIG. 20 on the sliding adjustment plate 120. FIGS. 23-28 show 6 different views of the sliding adjustment plate 120. Due to the nature of the design, there can be some clearance between the regulator and the adjustable gas block 160. Some gas does leak out of this clearance although amount of leakage is marginal; the design reduces that leakage or delays it as much as possible.

The sliding regulator plate 120 has grooves as gas trap baffles 210 cut along each side of the gas ports 150 and between the two gas ports. As gas passes over the gas trap baffles 210, turbulence is created which creates a gas trap between the adjustable gas block 50 and the top of the sliding adjustment plate 120. Likewise, gas trap baffles 230 are cut into the top of the adjustable gas block 160 at the entrance of each side of the regulator openings. This creates a gas trap between the gas block 160 and the bottom of the sliding adjustment plate 120. In another embodiment, a small hole can be machined at an angle at the bottom of the plate which would serve to jet gas into the gas trap baffles on the adjustable gas block.

Figures 23, 24, 25, 26, 27, 28:
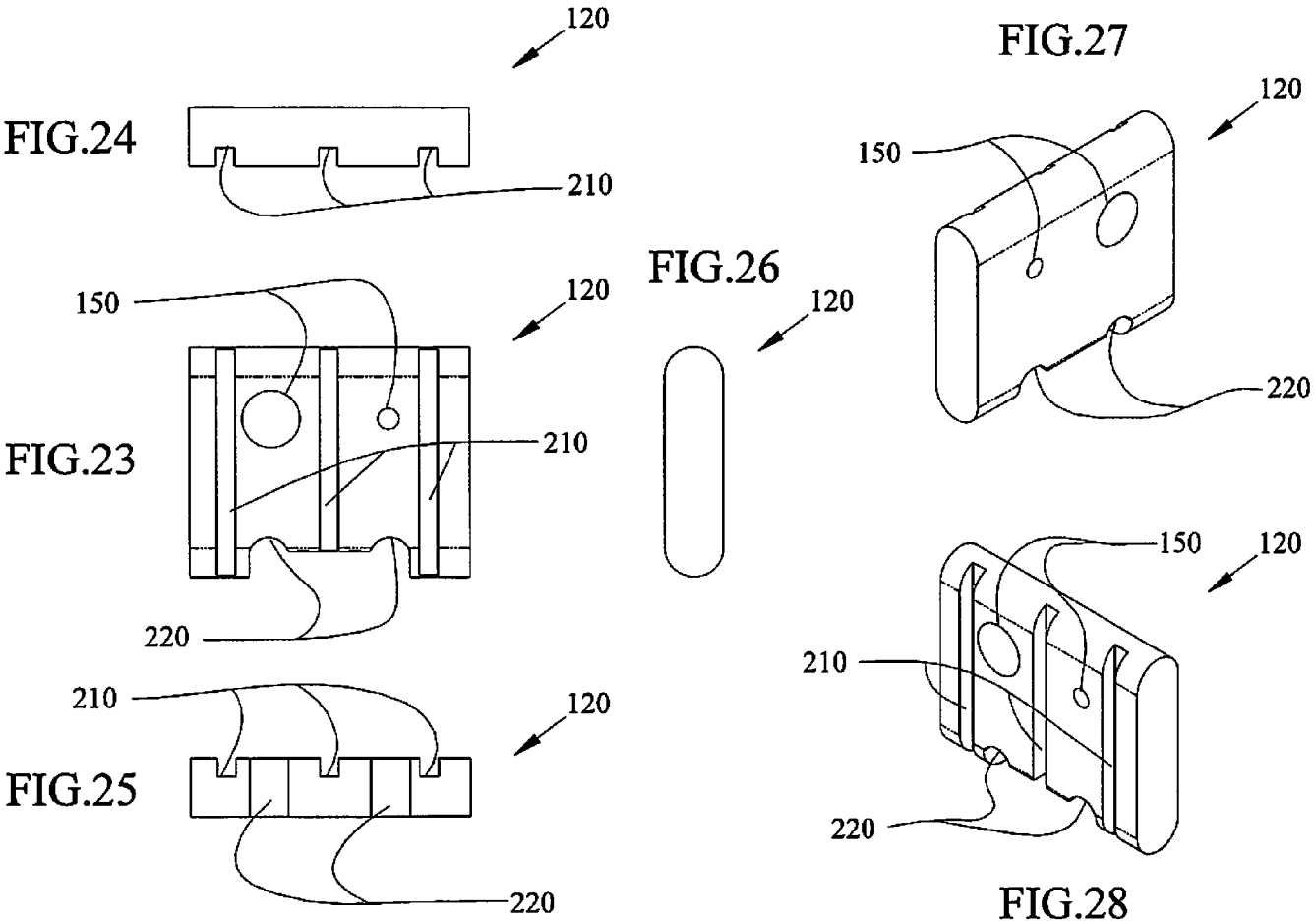
FIG. 23 is a top view of the 2 position adjustment plate.
FIG. 24 is a front view of the 2 position adjustment plate.
FIG. 25 is a rear view of the 2 position adjustment plate.
FIG. 26 is a side view of the 2 position adjustment plate.
FIG. 27 is a bottom perspective view of the 2 position adjustment plate.
FIG. 28 is a top perspective view of the 2 position adjustment plate.

FIG. 23 is a top view of the 2 position adjustment plate showing the two different gas ports 150, three parallel gas trap baffles 210, the two detent dimples 220 and the extended sides that act as a stop to prevent the adjustment plate 120 from being unintentionally removed. FIG. 23 also shows the alignment of each adjustment gas port 150 with the detent dimples 220. FIG. 24 is a front view of the 2 position adjustment plate 120 and FIG. 25 is a rear view of the 2 position adjustment plate 120 showing that the adjustment plate gas baffles 210 extending the length of the sliding adjustment plate 120 with the two detent dimples 220 located between the gas trap baffles 210. FIG. 26 is a side view of the 2 position sliding adjustment plate and FIGS. 27 and 28 are bottom and top perspective views, respectively, of the 2 position sliding adjustment plate 120.

Figure 29:
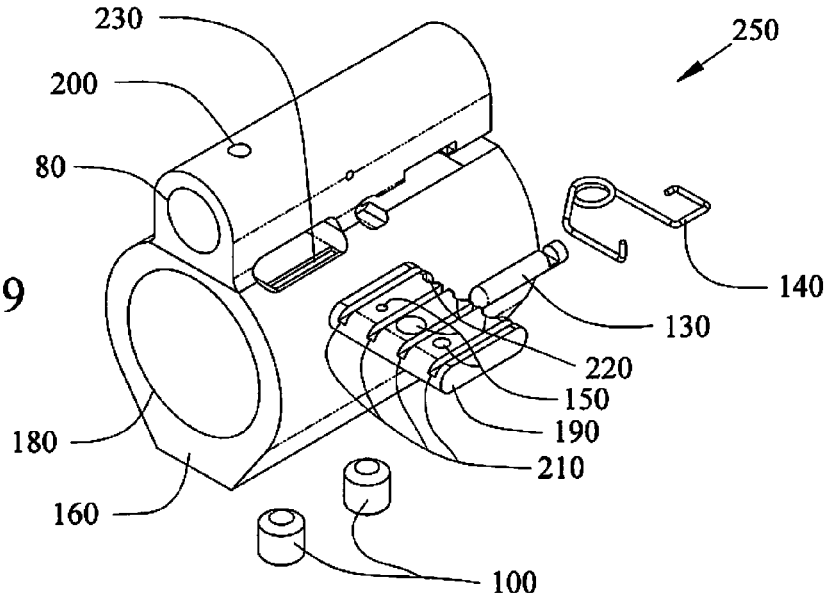
FIG. 29 is a top exploded perspective view of 3 position embodiment.
Figure 30:
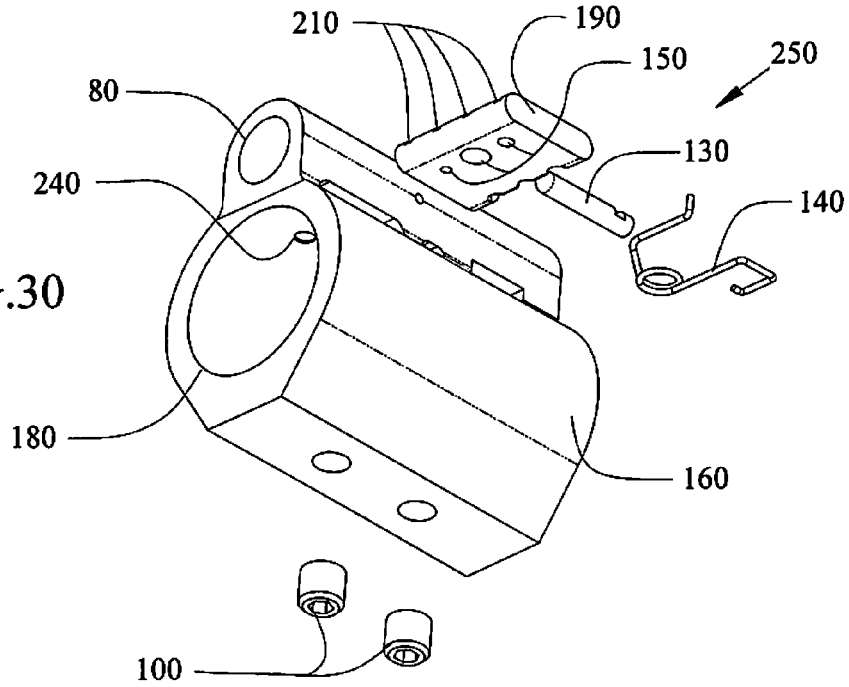
FIG. 30 is a bottom exploded perspective view.
Figure 31:
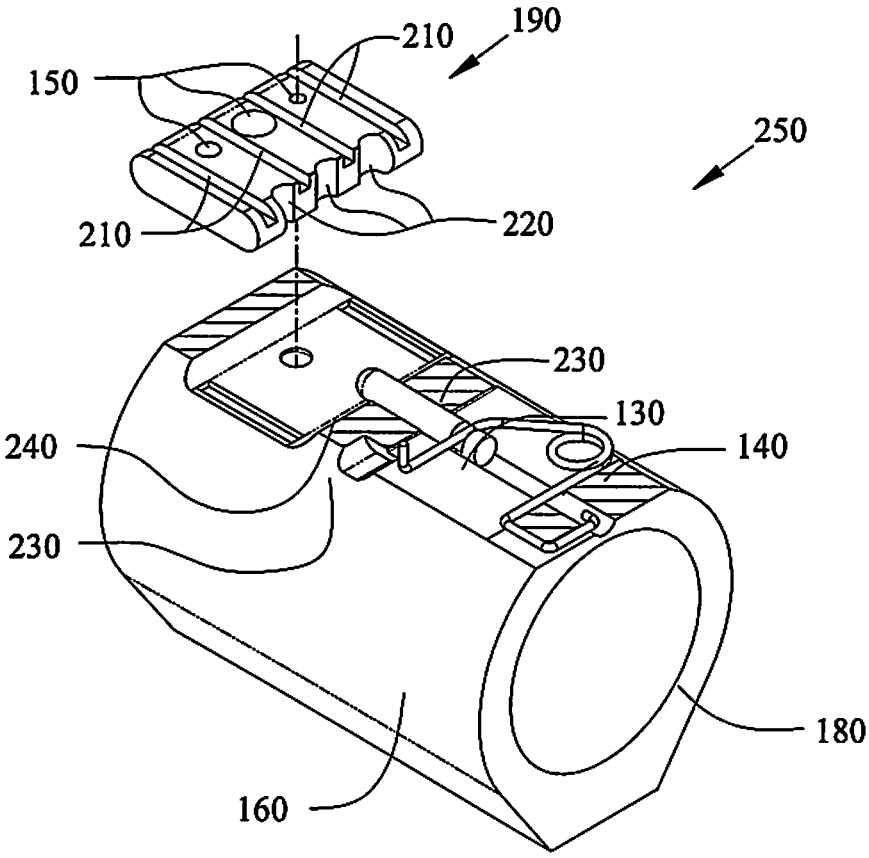
FIG. 31 is a top sectioned perspective showing 3 positions adjustable plate lifted to expose gas port.
Figure 37:
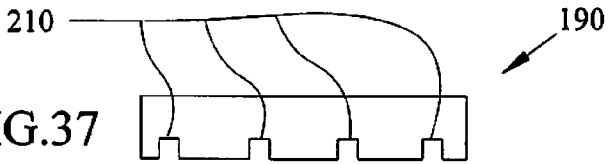
FIG. 37 is a rear view of 3 position adjustment plate.
Figure 36:
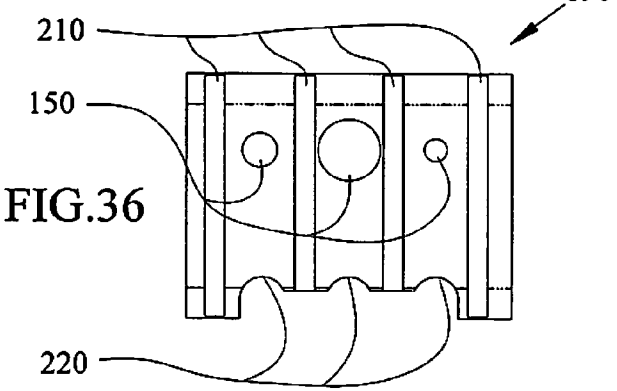
FIG. 36 is a top view of 3 position adjustment plate.
Figure 38:
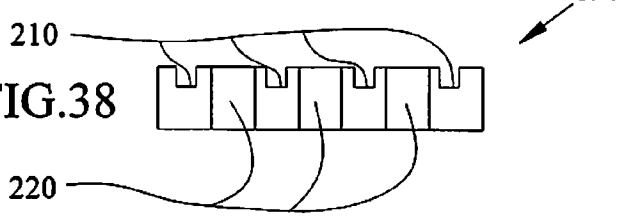
FIG. 38 is a front view of 3 position adjustment plate.

A second embodiment provides a 3 position sliding adjustment plate 190. FIGS. 29 and 30 are top and bottom, respectively, exploded perspective views of the three position embodiment. FIG. 31 is a top sectioned perspective view showing the 3 position sliding adjustment plate 190 lifted to expose gas port 240 in the adjustable gas block 160. FIGS. 36-41 show different views of the 3 position sliding adjustment plate 190. FIG. 36 is a top view of the 3 position sliding adjustment plate 190 and FIGS. 37 and 38 are rear and front, respectively, views of the 3 position sliding adjustment plate 190. As shown, the sliding adjustment plate 190 can have three gas ports 150 each of a different diameter, although the sliding adjustment plate can include a different number of gas ports such as the two gas port example previously shown and described or a three position adjustment plate with two gas ports separated by a position without a gas port, effectively blocking the gas in the barrel from escaping into the gas tube.

The 3 position sliding adjustment plate 190 also includes a fourth gas trap baffle 210 to capture any gas escaping from between the sliding adjustment plate 190 and the top of the adjustable gas block 160. The detent pin 130 and spring 140 are the same configuration and serve the same function as described for the 2 position embodiment.

Figure 33:
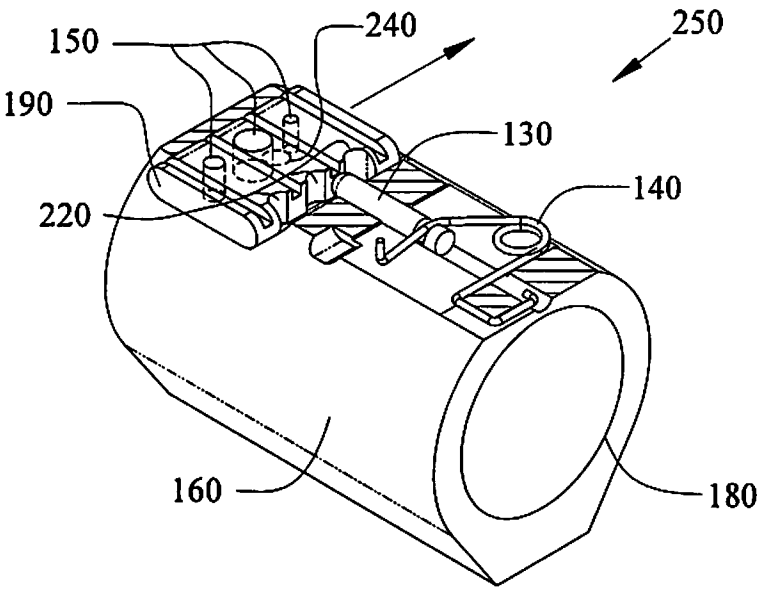
FIG. 33 is a sectioned perspective showing adjustment plate in transition between positions. Detent pin showing sliding on surface between the detent dimples.
Figure 32:
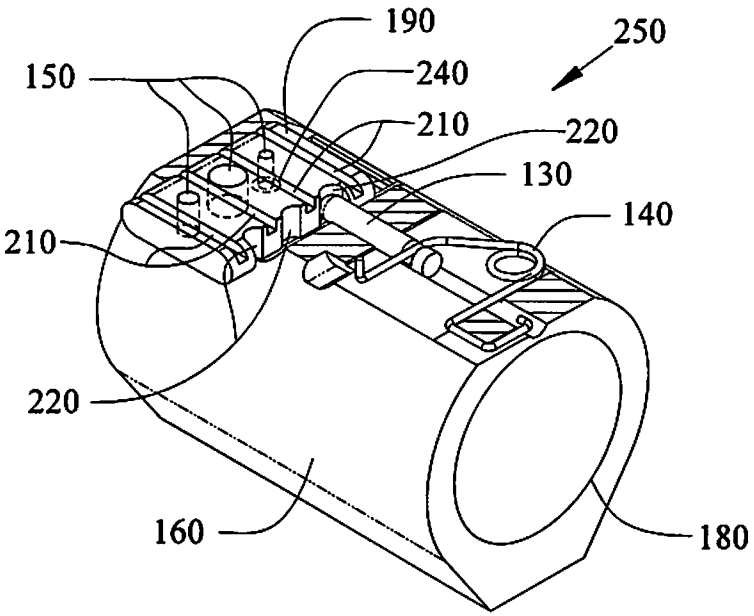
FIG. 32 is a sectioned perspective showing small-sized hole aligned with gas block gas port. Detent pin is shown seated in adjacent detent dimple.
Figure 35:
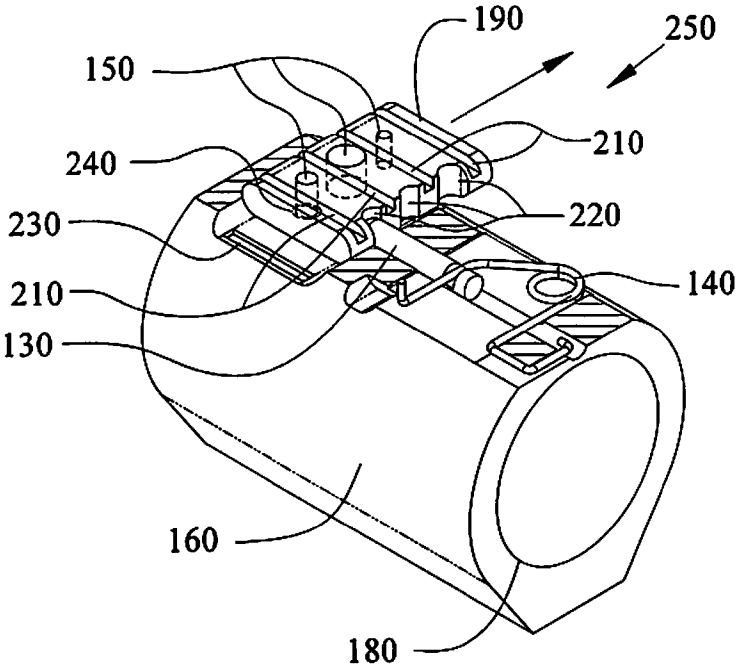
FIG. 35 is a sectioned perspective showing mid hole aligned with gas block gas port. Detent pin is shown seated in adjacent detent dimple.
Figure 34:
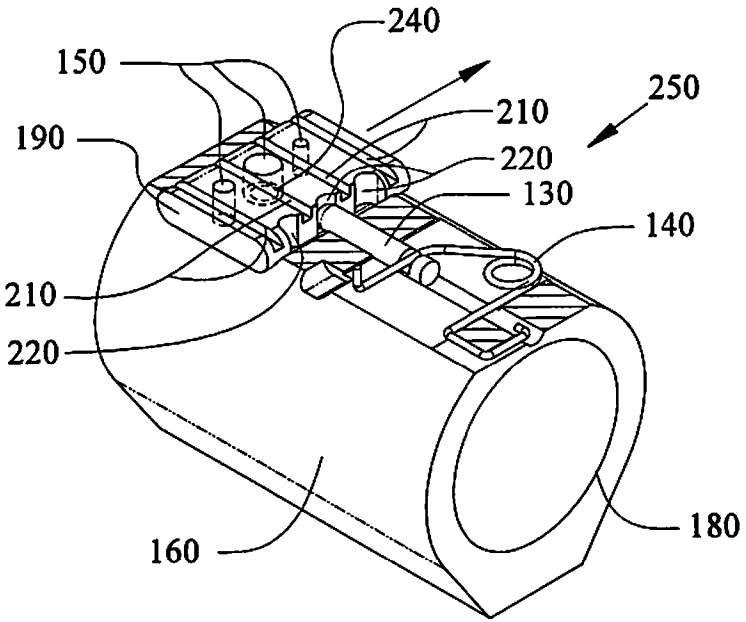
FIG. 34 is a sectioned perspective showing large hole aligned with gas block gas port. Detent pin is shown seated in adjacent detent dimple.
Figure 40:
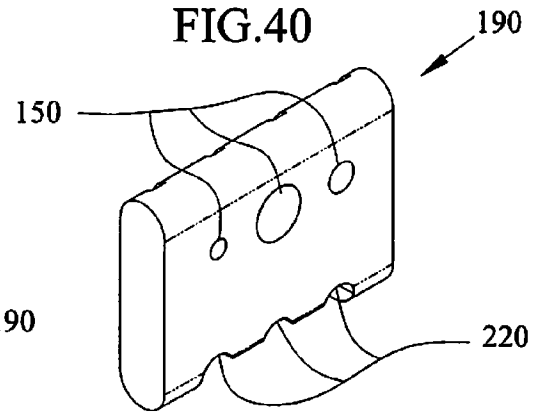
FIG. 40 is a bottom perspective of 3 position adjustment plate.
Figure 41:
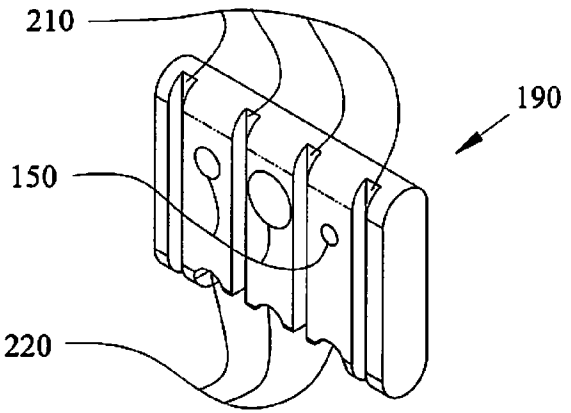
FIG. 41 is a top perspective of 3 position adjustment plate.
Figure 39:
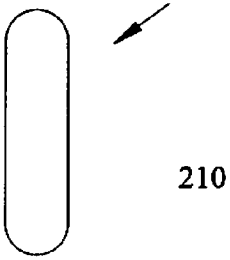
FIG. 39 is a side view of 3 position adjustment plate.

FIG. 32 is a sectioned perspective view showing a small-sized adjustment plate gas port 150 aligned with gas block gas port 240 with the detent pin 130 shown seated in detent dimple 220 aligned with the small sized adjustment plate gas port 150. In FIG. 33 the sliding adjustment plate 190 is shown in transition between positions as the detent pin 130 slides on the surface between two adjacent detent dimples 220. As the user continues to apply pressure to move the sliding adjustment plate 190, the detent pin 130 is seated in the next adjacent detent dimple 220 with the larger of the three gas ports 150 aligned with the gas port 240 in the adjustable gas block 160 as shown in FIG. 34. FIG. 35 is a sectioned perspective showing mid hole aligned with gas block gas port. Detent pin 130 is shown seated in adjacent detent dimple 220.

While the three gas ports are shown and described with a larger one of the gas ports in the center, the configuration is for example only and those skilled in the art will understand that the different diameter gas ports could be configured, for example, with the smallest gas port in the center position. Alternatively, the center position could not include a gas port, effectively blocking the gas discharge from the barrel from escaping into the gas tube via the adjustable gas block.

Figure 42:
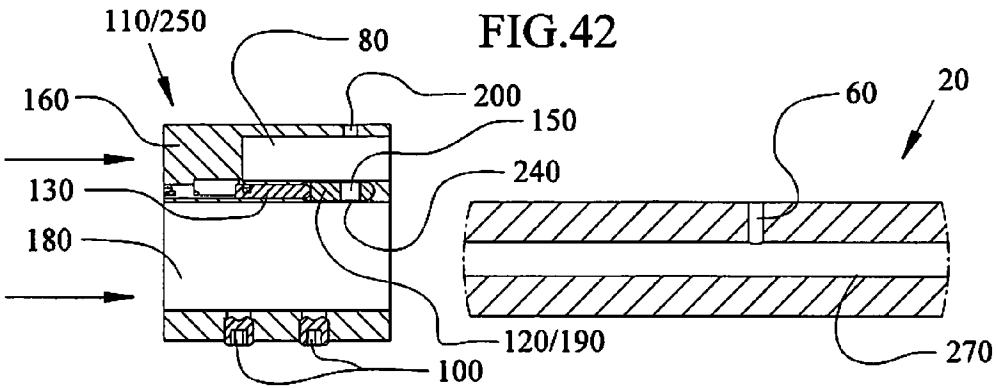
FIG. 42 is a section detail of new adjustable gas block installation onto rifle barrel. Block ready to slide onto barrel
Figure 44:
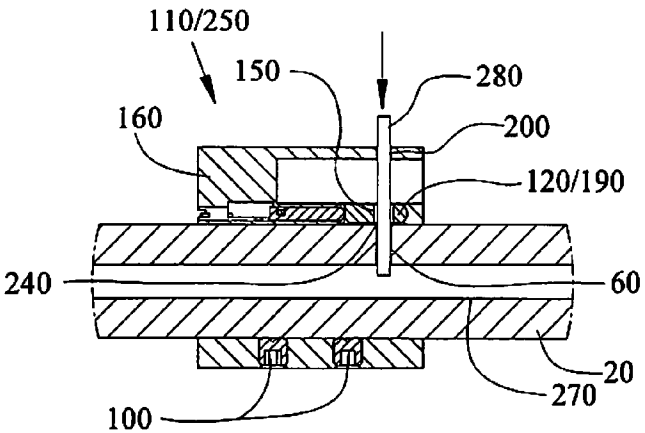
FIG. 44 shows the alignment pin shown penetrating block and barrel establishing alignment of gas ports. Set screws in gas block shown tightened.
Figure 43:
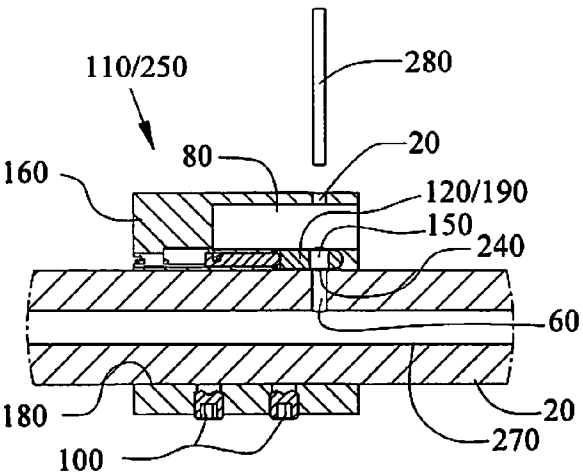
FIG. 43 shows the block slid over barrel ready to align block gas port to barrel port. Alignment pin positioned for alignment. Set screws in gas block shown backed off.

FIG. 42 is a section detail of new adjustable gas block assembly 110/240 installation onto rifle barrel 20 with the adjustable gas block 160 ready to slide onto barrel 20 in the direction shown by the arrows. FIG. 43 shows the adjustable gas block 160 slid over barrel 20 ready to align the block gas port 240 to the gas port 60 in the barrel with an alignment pin 280 positioned for alignment. The set screws in gas block are shown backed off so that the adjustable gas block 160 can be rotated and moved to align the two gas ports. FIG. 44 shows the alignment pin 280 penetrating the adjustable gas block 160 and barrel 20 establishing alignment of gas ports. With the gas ports aligned, the set screws in gas block are tightened as shown in FIG. 44.

In an alternative embodiment, the sliding adjustment plate is replaced with a dial. The dial uses a rotating adjustment disc in place of the sliding adjustment plate. The rotary adjustment plate is applicable for testing or use when conditions vary in terms of ammunition, springs and buffers and each can require a different diameter gas port. V1/V2 options have fewer settings since increasing the number of settings adds complexity to a law enforcement officer or soldier. Military users typically have standard issue ammunition, springs and buffers so the rotary dial adjustment disc is not the ideal solution. Law enforcement is typically along those lines, but may not be as strict.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An adjustable gas block assembly for a firearm comprising:

the adjustable gas block having a gas block barrel bore to slide the adjustable gas block over a barrel of the firearm and a gas tube bore to mate with a gas tube of the firearm, the adjustable gas block further including:

a gas port in the adjustable gas block between the barrel bore and the gas tube bore;

a sliding adjustment plate having two or more different adjustment plate gas ports movably positioned between the gas block barrel bore and the gas tube bore in the adjustable gas block to slide one of the two or more different adjustment plate gas ports into alignment with the gas port between the barrel bore and the gas tube bore and a barrel gas port; and a spring assembly including a spring coupled with a detent pin located in a trough in the adjustable gas block parallel along a centerline of the barrel of the firearm apply a horizontal force to hold a selected one of the two or more different adjustment plate gas ports in alignment with the barrel gas port; and one or more set screws for attaching the adjustable gas block to the barrel of the firearm.

2. The adjustable gas block assembly of claim 1 wherein the adjustable gas block further comprises:

an alignment hole in the top of the gas tube bore in alignment with the gas port in the adjustable gas block and the barrel gas port.

3. The adjustable gas block assembly of claim 1 wherein the sliding adjustment plate comprises:

a first adjustment plate gas port and a second adjustment plate gas port that is larger in diameter than the first adjustment plate gas port.

4. The adjustable gas block assembly of claim 3 further comprising:

a third adjustment plate gas port that is larger in diameter than the second adjustment plate gas port.

5. The adjustable gas block assembly of claim 1 wherein the sliding adjustment plate further comprises:

one or more adjustment plate baffles in a top side of the sliding adjustment plate to capture a gas escaping from space between the adjustment gas plate and the gas tube bore.

6. The adjustable gas block assembly of claim 1 further comprising:

one or more adjustable gas block baffles in the adjustable gas block below the sliding adjustment plate and parallel to the one or more adjustment plate baffles.

7. The adjustable gas block assembly of claim 1 wherein the spring assembly comprises:

two or more detent dimples in one side of the sliding adjustment plate each aligned with one of the two or more adjustment plate gas ports, the detent pin mating with the adjustment plate detent dimples.

8. An adjustable gas block comprising:

a body having a gas block barrel bore to slide the adjustable gas block over a barrel of a firearm and a gas tube bore to mate with the gas tube of the firearm;

a gas port in the adjustable gas block between the barrel bore and the gas tube bore;

a sliding adjustment plate having two or more different adjustment plate gas ports movably positioned between the barrel bore and the adjustable gas block gas port to slide one of the two or more different adjustment plate gas ports into alignment with the adjustable gas block gas port and the barrel gas port; and a spring assembly to hold a selected one of the two or more different adjustment plate gas ports in the sliding adjustment plate in alignment with a barrel gas port, the spring assembly including:

a spring; and a detent pin located in a trough in the adjustable gas block parallel with a centerline of the barrel of the firearm to apply a horizontal force to hold a selected one of the two or more different adjustment plate gas ports in alignment with the barrel gas port.

9. The adjustable gas block of claim 8 wherein the adjustable gas block further comprises:

an alignment hole in the top of the gas tube bore in alignment with the gas port in the adjustable gas block and the barrel gas port.

10. The adjustable gas block assembly of claim 8 wherein the sliding adjustment plate comprises:

a first adjustment plate position having a first gas port and a second adjustment plate position having a second gas port that is larger in diameter than the first gas port.

11. The adjustable gas block of claim 10 further comprising:

a third adjustment plate position having a third gas port that is larger in diameter than the second gas port.

12. The adjustable gas block of claim 10 further comprising:

a third adjustment plate position blocking the gas port in the adjustable gas block.

13. The adjustable gas block of claim 8 wherein the sliding adjustment plate further comprises:

one or more adjustment plate baffles in a top side of the sliding adjustment plate to capture a gas escaping from the space between the adjustment gas plate and the gas tube bore.

14. The adjustable gas block of claim 8 further comprising:

one or more adjustable gas block baffles parallel to the one or more adjustment plate baffles in the adjustable gas block below the sliding adjustment plate.

15. The adjustable gas block of claim 8 wherein the spring assembly comprises:

two or more detent dimples in one side of the sliding adjustment plate each aligned with one of the two or more adjustment plate gas ports, the detent pin mating with the adjustment plate detent dimples.

* * * * *